United States Patent [19]

Healey et al.

[11] 4,349,812

[45] Sep. 14, 1982

[54] MULTIPLE DETECTOR ALARM LATCH AND RELEASE SYSTEM

[75] Inventors: William E. Healey, Bloomfield Hills, Mich.; Morse R. Heineman, White Rock, N. Mex.

[73] Assignee: W. E. Healey and Associates, Inc., Bloomfield Hills, Mich.

[21] Appl. No.: 233,684

[22] Filed: Feb. 11, 1981

Related U.S. Application Data

[63] Continuation-in-part of Ser. No. 187,355, Sep. 15, 1980, abandoned.

[51] Int. Cl.[3] ..... G08B 19/00

[52] U.S. Cl. ..... 340/522; 340/520; 340/525

[58] Field of Search ..... 340/522, 525, 506, 507, 340/519–521, 524, 529

[56] References Cited

U.S. PATENT DOCUMENTS

| | | | |
|---|---|---|---|
| 3,530,464 | 9/1970 | Young | 340/525 |
| 3,548,399 | 12/1970 | Monigal et al. | 340/520 |
| 3,550,121 | 12/1970 | Porter, Jr. | 340/520 |
| 3,786,501 | 1/1974 | Marnerakis | 340/521 |

*Primary Examiner*—Thomas A. Robinson

*Assistant Examiner*—Donnie L. Crosland

*Attorney, Agent, or Firm*—Cullen, Sloman, Cantor, Grauer, Scott & Rutherford

[57] ABSTRACT

A plurality of fire, smoke, security or other detectors of the type which respond to the existence of a predetermined condition are each connected to an input circuit. Each input circuit is connected to one indicator circuit and when a detector is triggered, the input circuit associated with that detector generates a signal which in turn actuates and latches on the corresponding indicator circuit. The indicator circuit remains latched on even after the detector returns to an untriggered condition and the input circuit signal is removed. A first release circuit is provided to release all indicator circuits which have been latched on. When a predetermined number of detectors simultaneously respond to their respective predetermined conditions, an alarm signal generates an input to by-pass the first release circuit, thus precluding the first release circuit from releasing the plurality of indicator circuits. A second release circuit is provided to release all the indicator circuits after an alarm signal has been generated. The present system also provides a latched on signal indicative of intermittent fault conditions.

11 Claims, 4 Drawing Figures

SYSTEM COMMON
ALARM IN
V+

MULTIPLE DETECTOR ALARM LATCH AND RELEASE SYSTEM

CROSS-REFERENCE TO RELATED APPLICATIONS

This application is a continuation-in-part of our co-pending application Multiple Alarm Detector Monitoring And Command System filed Sept. 15, 1980, Ser. No. 187,355, the disclosure of which is hereby incorporated by reference.

BACKGROUND OF THE INVENTION

This invention relates generally to detector and alarm systems and, more particularly, to a latch and release system which is used to identify which detectors have been triggered.

There are various types of detector systems presently being marketed such as flame detectors, smoke detectors, ultraviolet detectors, unauthorized entry detectors, etc. These detectors typically provide a suitable output such as an audible signal, visible signal, or turn on a sprinkler system, etc., when a detector is activated. As described in the aforementioned co-pending application, a system has been developed where a particular action is taken, such as discharging a chemical agent to extinguish a fire, only after specific detectors are activated or a preselected number of detectors are simultaneously activated.

It is well-known that the various types of detectors, such as ultraviolet detectors, are self-resetting. This means that the detector automatically returns to its untriggered state. For example, an ultraviolet detector switches to a triggered condition only in the presence of ultraviolet light and automatically resets back to an untriggered condition in the absence of ultraviolet light. It is also known that detectors sometimes generate an intermittent or short duration spurious signal. Furthermore, battery powered detectors will often provide output signals as the battery voltage decreases due to age.

There are many situations where it is desired to have an indication of which detector was triggered even after that detector is reset. When a plurality of detectors are used in a single room or building, and each of the detectors are connected to a control panel, an audible or visible signal is usually provided to indicate when a detector is in the triggered condition. However, if the detector automatically resets, the audible signal is terminated and/or the visible signal is extinguished and hence, there is no indication of where the potential trouble exists.

Similarly, if one detector provides intermittent signals, spurious signals or signals indicating a decrease in the voltage of the power supply associated with such detector, it is desirable to have an indication of which detector provided such signals.

Prior to the present invention, it was suggested to use electrical relays for each detector so that when a detector was triggered, the actuation of the relay associated with that detector was used to energize a visible display signal which display signal had to be separately reset even after the detector returned to an untriggered condition. However, there is an extreme cost involved in providing an electrical relay for each detector in a system. In addition, in some instances, the signal from the detector was not strong enough or of sufficient duration to energize a relay.

Hence, prior to the present invention, there was no economical and satisfactory system for providing an indication of which one of several detectors had been actuated.

SUMMARY OF THE INVENTION

The present invention overcomes the shortcomings of the prior art by providing a latching and release system for a multiple detector alarm system to provide a display indicative of which one of several detectors was triggered with the display continuing even after the detector was reset.

The present system provides a plurality of input circuits each associated with and responsive to a different detector. The detectors, of course, would be located throughout the room or building being protected. A plurality of indicator circuits are provided, each associated with and receiving a signal from one of the input circuits. Each indicator circuit includes means to generate an output signal and to latch the output signal on to display which detector has been triggered. Since the indicator circuit is latched on, separate means are provided to release and reset the indicator circuit.

As set forth in the aforementioned co-pending application, there are certain instances where no action will be taken if a single detector is triggered but action would be taken if a predetermined number of detectors are simultaneously triggered. In utilizing the objectives of the aforementioned co-pending application in the present system, a first release means is provided to release the indicator circuit which has been latched on in the absence of a predetermined number of detectors being simultaneously triggered and a second release means is provided which by-passes the first release means and releases the indicator circuits which are latched on if the predetermined number of detectors are simultaneously triggered.

As an example of how the present system may be used, consider a building which is monitored by a plurality of detectors with each of the detectors connected to a control panel which provides both a visible alarm, such as a flashing light, and an audible signal, such as a horn, whenever any detector is triggered. An LED display board may be provided with an LED on the display board corresponding to the location of each detector. As a detector is triggered, the indicator circuit associated therewith latches on the corresponding LED so that a permanent display is provided of the detector which was triggered, even if the detector is self-resetting. A person monitoring the control panel would thereafter actuate the first release means to turn off the LED. If, however, several detectors were actuated simultaneously, and there was an automatic discharge of a fire extinguishing agent, the first release means would not be operative to release all the indicator circuits which had latched on. In this instance, a separate and distinct release means would by-pass the first release means and would require a key or other supervisory access to release the latched indicator circuits.

By use of the present invention, a person monitoring the control panel can determine if a particular detector is repeatedly triggering on and thus affirmative action may be taken to determine if there is a malfunction in that particular detector, or if there is a potential problem in the area monitored by that detector. If the detector which is repeatedly triggered is battery operated, the person monitoring the control panel can check the voltage of the batteries to determine whether the batteries are aging. The present invention maintains the display until released and thus provides an indication of which detector was triggered even after the detector has returned to its untriggered state. In the event of a predetermined number of detectors being simultaneously triggered and a fire extinguishing agent being actuated, the release means will be by-passed by a second release means which could be at a different location where access is limited to supervisory personnel or personnel from the company servicing the alarm system. In this fashion, inadvertent actuation of the first release means would not release the indicator circuits which were actuated.

The present invention also overcomes the problem of the prior art where electrical relays were provided for each detector. Intermittent signals of short duration would not energize a relay. The present invention has a response time of approximately 5 milliseconds. Thus intermittent or short duration signals will be detected and responded to by the present invention.

BRIEF DESCRIPTION OF THE DRAWINGS

The foregoing objects and advantages of the present invention, together with other objects and benefits which may be attained by its use, will become more apparent upon reading the following detailed description of the invention taken in conjunction with the drawings.

In the drawings, wherein like reference numerals identify corresponding parts.

DETAILED DESCRIPTION OF THE INVENTION

Figures 1, 2, 3, 4:
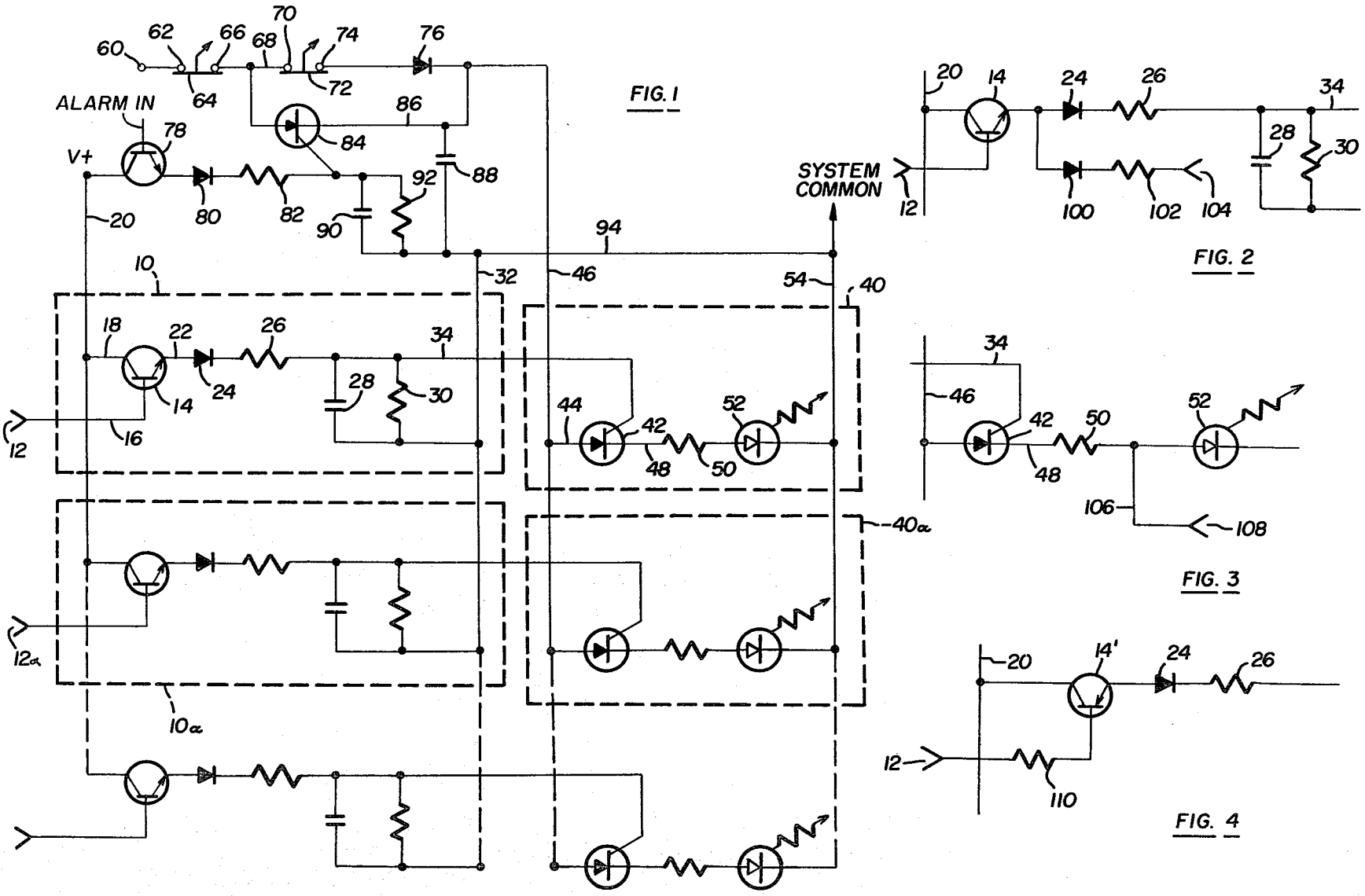
FIG. 1 is a circuit diagram of the present invention.
FIG. 2 is a circuit diagram of a modification of an input circuit.
FIG. 3 is a circuit diagram showing a modification of an indicator circuit.
FIG. 4 is a circuit diagram of yet another modification of the input circuit.

With reference to the drawings, FIG. 1 is a circuit diagram of the present invention including a plurality of individual input circuits 10, 10*a*, etc. Each input circuit is associated with a single detector, not shown, and when the detector associated with a particular input circuit is triggered, a positive signal is applied to the input circuit at input terminal 12. That is, for example, when a first detector is triggered, an input signal is provided at input terminal 12 to the input circuit 10 and if a second detector is triggered an input signal is provided at input terminal 12*a* to the input circuit 10*a*. Each input circuit includes a first NPN transistor 14 having its base connected by a lead 16 to the input terminal 12 associated with that particular input circuit. The collector of transistor 14 is connected by lead 18 to a bus 20 which is the positive bus for the system and is provided with positive 24-volt D.C. The emitter of the transistor 14 is connected on lead 22 through a series combination of a diode 24 and a resistor 26 and then to a noise filter comprising the parallel combination of a capacitor 28 and a resistor 30. One side of the noise filter is coupled to bus 32 (which is ultimately connected to the system common bus as will be hereinafter described) and the opposite side of the noise filter is connected along lead 34 to provide an output from the input circuit 10.

The present system also includes a plurality of indicator circuits 40, 40*a*, etc., each indicator circuit being associated with and electrically connected to one of the input circuits 10, 10*a*, etc. Each indicator circuit is the same and hence one indicator circuit will be explained. Indicator circuit 40 includes an SCR 42 having its gate receiving an input signal on lead 34 from the output of the corresponding input circuit 10. The SCR 42 has its anode connected along lead 44 to an anode bus 46 and has its cathode connected on lead 48 to one side of a resistor 50. The other side of resistor 50 is connected to the anode of an LED (light emitting diode) 52 and the opposite side of the LED 52 is connected to the common bus 54. This completes the description of one of the individual indicator circuits.

The releasing means of the present system, which is provided for turning off the indicator circuits will now be explained. A source of 8-volt positive D.C. is provided at an input terminal 60 and the positive 8-volt is connected to a first side 62 of a normally closed first push-button switch 64. The second side 66 of the push-button switch is connected along lead 68 to the first side 70 of a second normally closed push-button switch 72,. The opposite side 74 of the push-button switch 72 is connected through a diode 76 to the anode bus 46.

As heretofore explained, and as set forth in greater detail in the aforementioned co-pending application, an alarm signal may be provided when a predetermined number of detectors are simultaneously actuated. For the purpose of the present invention, it will be assumed that the alarm signal is provided to the base of an alarm transistor 78. The collector of the alarm transistor 78 is connected to the positive bus 20 and the emitter of the alarm transistor 78 is connected through the series combination of a diode 80 and resistor 82 to the gate electrode of a master SCR 84. The anode of the master SCR 84 is connected to lead 68 in between the first and second push-button switches and the cathode of the SCR 84 is connected on lead 86 to the junction of the diode 76 and the anode bus 46 associated with the indicator circuits. A first filtering capacitor 88 is coupled between cathode lead 86 and bus 32 and a noise filter comprising the parallel combination of a capacitor 90 and a resistor 92 is connected between the gate electrode of the SCR 84 and the bus 32. Bus 32 is connected by lead 94 to the system common bus 54.

This completes the description of the circuit of the present invention and the operation of the circuit will now be explained. When a detector is triggered a positive signal is supplied at the input terminal which is electrically connected to the particular detector which was triggered. Assume this is input terminal 12. The positive signal at input terminal 12 along lead 16 switches the NPN transistor 14 into a conductive state. This provides a current flow path from the positive bus 20 through the transistor 14 across diode 24 and resistor 26 to the noise filter comprising the parallel combination of capacitor 28 and resistor 30. The signal continues along lead 34 to the gate of an SCR 42 in the indicator circuit 40 associated with the input circuit 10. Positive voltage is applied at the terminal 60 through the two push-button switches 64, 72 (both of which are normally closed) and along the bus 46 to the anode of the SCR 42. The input signal at the gate of SCR 42 causes the SCR to conduct thus providing a signal to the light emitting diode 52. The light emitting diode would be on a display panel corresponding in location to the physical location of the detector within the building. Hence, the light emitting diode 52 will be actuated thus providing a visible display. The purpose of the noise filter is to prevent spurious signals from actuating the SCR 42 since the SCR gate electrode is susceptible to noise.

If the detector which was triggered is of the self-resetting type, or if the triggering was actually a noise signal, or if the detector is battery powered and the signal was merely an indication that the voltage of the battery was dropping, the positive signal at the base of transistor 14 will be of relatively short duration. Nonetheless, once the SCR 42 fires, the SCR 42 continues to conduct and the light emitting diode 52 remains on until power is removed from the anode of the SCR.

At this point it should be understood that a plurality of detectors could have been actuated simultaneously or even in sequence and thus at any time several light emitting diodes may be on. In order to turn off the light emitting diodes, it is necessary to remove the power from the anode of the SCR and this is done by momentarily depressing a first release means, specifically the push-button switch 72 to open the circuit between the power supply at terminal 60 and the anodes of all of the SCRs which are associated with individual indicator circuits.

When the present invention is used in conjunction with a circuit as described in the co-pending application, wherein the simultaneous actuation of a predetermined number of detectors results in an alarm signal, this will be indicated by a positive signal at the base of transistor 78. The positive signal at the base of transistor 78 is coupled to the gate electrode of the master SCR 84. A noise filter circuit comprising capacitor 90 and resistor 92 is coupled between the gate electrode of the master SCR 84 and the bus 32 because of the sensitivity of an SCR to noise. Once the SCR 84 fires, power is coupled from the power supply at terminal 60 through the push-button switch 64 and through the SCR 84 and back along the anode bus 46 to the anodes of each of the SCRs in the respective indicator circuits. Thus, it may be appreciated that the SCR 84 effectively by-passes the push-button switch 72 and once the SCR 84 fires, actuation of push-button switch 72 will not remove the signal from the anodes of the various SCRs in the indicator circuits. Thus it is necessary to actuate the second release means, specifically push-button switch 64, to remove power from the anode of the master SCR 84 to thus remove the power from the individual SCRs in each of the indicator circuits.

In actual operation, push-button switch 72 may be on the front of a control panel while push-button switch 64 may be located at the rear of the panel and may be operated by a key or other limited access device. Thus, once an alarm has sounded, even the inadvertent depressing of push-button switch 72 will not extinguish the LEDs. Hence it is not possible to inadvertently remove the display indicative of the detectors which have triggered which result in an alarm condition.

The foregoing is a complete description of the preferred embodiment of the present invention. Reference should now be had to FIGS. 2, 3 and 4 for a description of various alternate embodiments of the present invention.

FIG. 2 illustrates a modification of the input circuit to provide not only the signal on lead 34 to fire the SCR but also to provide a non-latching output signal indicative of the triggering of a detector. This may be connected to an audible alarm or the like which would provide a momentary signal only when the detector is in a triggered condition. The circuit of FIG. 2 includes not only the diodes 24 and 26 from the emitter of transistor 14 to the noise suppression filter 28, 30, but also a second series combination of a resistor and a diode, specifically, a diode 100 connected between the emitter of transistor 14 and the diode 24 with the diode 100 thereafter being connected in series to a resistor 102. The opposite side of the resistor 102 from the diode 100 is an output terminal 104 which may be connected to an alarm circuit to provide a non-latching audible alarm in response to the presence of a signal at terminal 104.

FIG. 3 illustrates a modification of an indicator circuit to provide a second latching output in addition to the LED latching output. Specifically, a lead 106 is connected between the resistor 50 and the LED 52 and lead 106 terminates in an output terminal 108. When the SCR 42 fires, not only is the LED 52 illuminated, but also a signal is provided at terminal 108. Both the illumination of the LED 52 and the signal at terminal 108 are latched on by the firing of the SCR and remain on until the power is removed from the anode bus 46.

The modification of FIG. 4 is provided because certain types of detectors provide a negative signal when they are triggered while other types of detectors provide a positive signal when they are triggered. If a given detector provides a positive output signal, then the input circuit 10 associated with that detector would be as illustrated in FIG. 1 and as previously described. However, where the detectors of the type which provide a negative output signal, a modified input circuit as illustrated in FIG. 4 would be required. The circuit of FIG. 4 includes a PNP transistor 14' having its collector connected on lead 18 to the positive input bus 20 and the output taken from its emitter along lead 22 to the series combination of a diode 24 and a resistor 26. However, a resistor 110 is now provided between the base of transistor 14' and the input terminal 12.

The present invention may be utilized to monitor a plurality of circuits and provide a latched on display signal indicating the existence of an intermittent or permanent fault. For example, consider a system where a plurality of circuits each provide +24 volts d.c. The system of FIG. 1, as modified by the input circuits of FIG. 4 may be used to monitor the plurality of circuits. If the voltage at any of the circuits dropped below +24 volts D.C., indicating a fault or undesired condition, the voltage at the base of the transistor 14' associated with such circuit would drop causing the transistor to conduct thus firing the SCR of the indicator circuit associated with the input circuit.

Accordingly, the present system may be used to simultaneously monitor circuit parameters of a plurality of circuits and respond to a change in the parameter in any one or more of the circuits being monitored.

The foregoing is a complete description of a preferred embodiment of the present invention. Many changes and modifications may be made without departing from the spirit and scope of the present invention. The present invention, therefore, should be limited only by the following claims.

What is claimed is:

1. In an alarm system of the type including a plurality of detectors, each detector having an untriggered condition and a triggered condition, the triggered condition indicating that the detector has sensed a condition for which a signal should be generated, and alarm means for generating an alarm signal when a predetermined plurality of detectors are simultaneously triggered, the improvement comprising:

a plurality of input circuits, each input circuit associated with and electrically connected to one of said detectors for providing a first output signal only when the detector associated therewith is in a triggered condition;

a plurality of indicator circuits, each associated with and electrically connected to one of said input circuits;

each of said indicator circuits normally being off; each said indicator circuit for switching into an on condition and latching in said on condition in response to the output signal from the input circuit associated therewith;

first release means to simultaneously release all of said indicator circuits which are latched on in the absence of an alarm signal; and second release means to by-pass said first release means and for releasing all of said indicator circuits which are latched on in the presence of an alarm signal;

said second release means by-passing said first release means for preventing the releasing of said indicator circuits by said first release means after an alarm signal has been received.

2. The invention as defined in claim 1 wherein each indicator circuit includes an SCR which is fired by the output from the input circuit associated therewith.

3. The invention as defined in claim 2 wherein said first release means renders the SCR of each indicator circuit non-conductive.

4. The invention as defined in claim 1 wherein said second release means includes a master SCR to by-pass said first release means such that upon firing said master SCR, actuation of said first release means will not release the latched indicator circuits.

5. The invention as defined in claim 1 where each of said indicator circuits includes a visible display associated therewith; actuation of said visible display for identifying the particular detector which has been triggered.

6. The invention as defined in claim 1 wherein all of said input circuits receive positive signals when the detectors associated therewith are in a triggered condition.

7. The invention as defined in claim 1 wherein at least one of said input circuits receives a negative input signal when the detector associated therewith is in a triggered condition.

8. The invention as defined in claim 1 wherein the output generated by an input circuit also provides a non-latching output signal.

9. In a system of the type including a plurality of monitored circuits, each having a normal condition and a fault condition, the fault condition indicating that the monitored circuit has changed so that a signal should be generated, and alarm means for generating an alarm signal when a predetermined plurality of monitored circuits are simultaneously in a fault condition, the improvement comprising:

a plurality of input circuits, each input circuit associated with and electrically connected to one of said monitored circuits for providing a first output signal only when the monitored circuit associated therewith is in a fault condition;

a plurality of indicator circuits, each associated with and electrically connected to one of said input circuits;

each of said indicator circuits normally being off; each said indicator circuit for switching into an on condition and latching in said on condition in response to the output signal from the input circuit associated therewith;

first release means to simultaneously release all of said indicator circuits which are latched on in the absence of an alarm signal; and second release means to by-pass said first release means and for releasing all of said indicator circuits which are latched on in the presence of an alarm signal;

said second release means by-passing said first release means for preventing the releasing of said indicator circuits by said first release means after an alarm signal has been received.

10. A method of monitoring a plurality of detectors, each of which detectors has an untriggered state and a triggered state comprising the steps of:

illuminating a visible display when a detector changes from an untriggered state into a triggered state;

latching said visible display in an illuminated condition so that said illuminated display remains illuminated when the detector switches back to an untriggered state;

providing a first release for releasing said latched illuminated display to remove the illumination therefrom; and providing a second release to by-pass said first release, said second release for both removing the illumination from said latched illuminated display and for preventing inadvertent turning off of the illuminated display caused by actuation of said first release.

11. A method of monitoring a plurality of circuits, each of which circuits has a normal output and a fault output, comprising the steps of:

illuminating a visible display when a circuit changes from a normal output into a fault output;

latching said visible display in an illuminated condition so that said illuminated display remains illuminated when the circuit switches back to a normal output;

providing a first release for releasing said latched illuminated display to remove the illumination therefrom; and providing a second release to by-pass said first release, said second release for both removing the illumination from said latched illuminated display and for preventing inadvertent turning off of the illuminated display caused by actuation of said first release.

* * * * *